US011837066B2

(12) United States Patent
Ten Kate et al.

(10) Patent No.: US 11,837,066 B2
(45) Date of Patent: Dec. 5, 2023

(54) FALL DETECTION APPARATUS, A METHOD OF DETECTING A FALL BY A SUBJECT AND A COMPUTER PROGRAM PRODUCT FOR IMPLEMENTING THE METHOD

(71) Applicant: KONINKLIJKE PHILIPS N.V., Eindhoven (NL)

(72) Inventors: Warner Rudolph Theophile Ten Kate, Waalre (NL); Doortje Van De Wouw, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 17/826,248

(22) Filed: May 27, 2022

(65) Prior Publication Data

US 2022/0284788 A1 Sep. 8, 2022

Related U.S. Application Data

(63) Continuation of application No. 17/254,968, filed as application No. PCT/EP2019/066571 on Jun. 24, 2019, now Pat. No. 11,361,648.

(30) Foreign Application Priority Data

Jun. 29, 2018 (EP) ..... 18180769

(51) Int. Cl.
*G08B 21/04* (2006.01)

(52) U.S. Cl.
CPC ..... *G08B 21/043* (2013.01)

(58) Field of Classification Search
CPC ..... G08B 21/043; G08B 29/188
See application file for complete search history.

(56) References Cited

U.S. PATENT DOCUMENTS 8,909,497 B1 12/2014 Shkolnikov
9,402,568 B2 8/2016 Barfield
(Continued)

FOREIGN PATENT DOCUMENTS

JP 2009230335 A 10/2009
WO 2016092487 A1 6/2016
(Continued)

OTHER PUBLICATIONS

International Search Report and Written Opinion, International Application No. PCT/EP2019/066571, dated Sep. 13, 2019.
(Continued)

*Primary Examiner* — Curtis J King

(57) ABSTRACT

According to an aspect, there is provided a fall detection apparatus, the fall detection apparatus comprising one or more processing units configured to obtain a first input indicating which one or ones of a plurality of fall detection algorithms have detected a potential fall by the subject, wherein each fall detection algorithm of the plurality of fall detection algorithms is associated with a respective type of fall and detects a potential fall of the associated type by analysing a set of movement measurements for the subject, wherein each respective type of fall has an associated initial state of the subject; obtain a second input indicating the status of the subject prior to the potential fall, wherein the status of the subject is determined by analysing a set of measurements from one or more sensors in the environment of the subject; compare the determined status of the subject prior to the potential fall to the initial state for each type of fall associated with any potential fall indicated in the first input; and output an indication that the subject has fallen if the determined status of the subject matches the initial state of any of the respective types of fall associated with any potential fall indicated in the first input.

18 Claims, 2 Drawing Sheets

(56) References Cited

U.S. PATENT DOCUMENTS

| | | | | |
|---|---|---|---|---|
| 9,495,855 | B2 | 11/2016 | Hanson et al. | |
| 9,940,822 | B2 | 4/2018 | Sella | |
| 10,043,368 | B1 * | 8/2018 | Fonzi, III | G08B 21/0446 |
| 10,335,059 | B2 | 7/2019 | Annegarn et al. | |
| 11,170,295 | B1 * | 11/2021 | Carmichael | G06N 3/084 |
| 2008/0001735 | A1 | 1/2008 | Tran | |
| 2011/0152727 | A1 | 6/2011 | Ten Kate et al. | |
| 2012/0101411 | A1 * | 4/2012 | Hausdorff | A61B 5/1117 600/595 |
| 2013/0054180 | A1 * | 2/2013 | Barfield | G01P 15/0891 702/141 |
| 2014/0276238 | A1 * | 9/2014 | Osorio | G08B 21/0446 600/595 |
| 2015/0145662 | A1 | 5/2015 | Barfield et al. | |
| 2016/0307427 | A1 | 10/2016 | Haflinger et al. | |
| 2017/0270481 | A1 * | 9/2017 | Morgenthau | H04W 4/80 |
| 2017/0281054 | A1 | 10/2017 | Stever et al. | |
| 2017/0354350 | A1 | 12/2017 | Di Croce et al. | |
| 2018/0113006 | A1 | 4/2018 | Tyrer | |
| 2018/0121861 | A1 * | 5/2018 | Morgenthau | G06Q 10/063114 |
| 2018/0151037 | A1 * | 5/2018 | Morgenthau | G08B 25/016 |
| 2018/0271410 | A1 | 9/2018 | Rawal | |
| 2018/0284223 | A1 | 10/2018 | Otsuki | |
| 2018/0342081 | A1 * | 11/2018 | Kim | G06V 20/52 |
| 2019/0090786 | A1 * | 3/2019 | Kim | G06N 3/08 |
| 2020/0046262 | A1 | 2/2020 | Annegarn et al. | |
| 2021/0005071 | A1 * | 1/2021 | Sharma | A61B 5/1121 |
| 2021/0173045 | A1 * | 6/2021 | Hu | G01S 7/415 |
| 2022/0180723 | A1 * | 6/2022 | Cheng | G01S 13/62 |

FOREIGN PATENT DOCUMENTS

| | | | |
|---|---|---|---|
| WO | 2018029193 | A1 | 2/2018 |
| WO | 2018069262 | A1 | 4/2018 |

OTHER PUBLICATIONS

Delahoz, Y. et al., "Survey on Fall Detection and Fall Prevention Using Wearable and External Sensors", Sensors 2014, 14, 19806-19842.

* cited by examiner

FALL DETECTION APPARATUS, A METHOD OF DETECTING A FALL BY A SUBJECT AND A COMPUTER PROGRAM PRODUCT FOR IMPLEMENTING THE METHOD

CROSS-REFERENCE TO PRIOR APPLICATIONS

This application is a continuation of U.S. application Ser. No. 17/254,968 filed on Dec. 22, 2020 which is the U.S. National Phase application under 35 U.S.C. § 371 of International Application No. PCT/EP2019/066571, filed on Jun. 24, 2019, which claims the benefit of EP Patent Application No. EP 18180769.4, filed on Jun. 29, 2018. These applications are hereby incorporated by reference herein.

FIELD OF THE INVENTION

The disclosure relates to the detection of falls by a subject, and in particular to a fall detection apparatus, a method of detecting a fall by a subject and a computer program product for implementing the method that can detect a number of different types of fall.

BACKGROUND OF THE INVENTION

With ageing, physical ability declines. A person's mobility may be affected and they may experience difficulty in maintaining their independence. A large category of difficulties concern falls, which may have dramatic outcomes to the health state of the person falling.

Falls affect millions of people each year and result in significant injuries, particularly among the elderly. In fact, it has been estimated that falls are one of the top three causes of death in elderly people. A fall is defined as a sudden, uncontrolled and unintentional downward displacement of the body to the ground, followed by an impact, after which the body stays down on the ground.

A personal emergency response system (PERS) is a system in which help for a subject can be requested. By means of Personal Help Buttons (PHBs) the subject can push the button to summon help in an emergency. Also, if the subject suffers a severe fall (for example by which they get confused or even worse if they are knocked unconscious), the subject might be unable to push the button, which might mean that help doesn't arrive for a significant period of time, particularly if the subject lives alone. The consequences of a fall can become more severe if the subject stays lying for a long time.

Thus the PHBs can include one or more sensors, for example an accelerometer (usually an accelerometer that measures acceleration in three dimensions) and an air pressure sensor (for measuring the height, height change or absolute altitude of the PHB), and the output of the sensors can be processed to determine if the subject has suffered a fall. This processing can involve inferring the occurrence of a fall by processing the time series generated by the accelerometer and air pressure sensor. In general, a fall detection algorithm tests on one or more features such as, but not limited to, impact, orientation, orientation change, height change, and vertical velocity. Reliable fall detection results when the set of computed values for these features is different for falls than for other movements that are not a fall. On detecting a fall, an alarm is triggered by the PHB without the subject having to press the button.

Effort is being put into providing robust classification methods or processing algorithms for detecting falls accurately, since, clearly, it is important to correctly identify a fall by the subject so that assistance can be provided, and the occurrence of false alarms (FA) should be minimised (or even prevented altogether). Thus automatic fall detection algorithms are optimised to trade false alarms against the fall detection probability.

However, a problem with achieving reliable fall detection is that not all falls are the same and different types of falls can have different features. Usually the optimisation of fall detection algorithms mean that falls from stance (i.e. fall from a standing/upright posture) are reliably detected, but this means that falls from lower positions or involving composite movements might be missed. Examples include falling from a chair, falling out of bed, falling when trying to stand up or when trying to sit down. Falls can also be staged, in the sense that the subject does not fall straight to the ground, but, for example, the subject slides down the wall, grasps some furniture (e.g. a table, chair, bed, etc.), or falls against furniture. These issues with reliable fall detection are particularly important for subjects that use wheelchairs, and have additional risk of falling when getting into or out of their wheelchair.

SUMMARY OF THE INVENTION

A current trend is for the home or care environment to various include sensors for monitoring the home environment or particular objects in that environment. These sensors are increasingly 'connected' in the sense that the sensor measurements or products of the analysis of sensor measurements can be communicated to other devices (e.g. a remote server, a central home monitoring system, a smartphone, etc.) via wired or wireless connections through a local network or over the Internet. These connected sensors are often referred to as the Internet of Things (IoT) or Internet of Medical Things (IoMT). Since these sensors may monitor where the subject is in the environment, what the subject is doing (e.g. which object the subject is using), etc., the sensors may have information that is useful to a fall detection algorithm (that typically operates on measurements of the movements of the subject) to optimise the fall detection decisions.

However, given the vast array of different sensor types that can be present in a home or care environment, it will be difficult to integrate measurements from the sensors actually present in the environment in a fall detection algorithm implemented by a PHB or other dedicated fall detector. One way to achieve the integration is for the PHB or other dedicated fall detector to include a discovery and communication protocol for connecting to any possible sensor that is available in the home or care environment. The PHB or other dedicated fall detector would need to understand all possible configurations, sensor types, formats and protocols. Maintenance and flexibility of the system would be difficult in this architectural configuration and subjects may face the disappointing experience that adding another sensor in the home environment that could be used in the fall detection might be difficult, or even impossible since it is not supported by their PHB/fall detector software version. Also this type of installation or set up of the system will be difficult for elderly subjects (the typical users of fall detectors).

Therefore, there is a need for an improved fall detection apparatus, method of detecting a fall by a subject and a computer program product for implementing the method that can make use of information obtained by sensors in the environment of the subject to improve the reliability of fall detection, and in particular improving the reliability of the detection of different types of falls.

According to a first specific aspect, there is provided a fall detection apparatus, the fall detection apparatus comprising one or more processing units configured to obtain a first input indicating which one or ones of a plurality of fall detection algorithms have detected a potential fall by the subject, wherein each fall detection algorithm of the plurality of fall detection algorithms is associated with a respective type of fall and detects a potential fall of the associated type by analysing a set of movement measurements for the subject, wherein each respective type of fall has an associated initial state of the subject; obtain a second input indicating the status of the subject prior to the potential fall, wherein the status of the subject is determined by analysing a set of measurements from one or more sensors in the environment of the subject; compare the determined status of the subject prior to the potential fall to the initial state for each type of fall associated with any potential fall indicated in the first input; and output an indication that the subject has fallen if the determined status of the subject matches the initial state of any of the respective types of fall associated with any potential fall indicated in the first input. Thus, the first aspect provides that information obtained by sensors in the environment of the subject can be used to determine if a potential fall detected by one or more fall detection algorithms adapted for respective types of fall is an actual fall. This improves the reliability of detection of different types of falls.

In some embodiments, the one or more processing units are further configured to determine that the subject has not fallen if the determined status of the subject does not match the initial state for any of the respective types of fall associated with any potential fall indicated in the first input. This means that potential falls identified by a particular fall detection algorithm (associated with a type of fall) can be disregarded where the subject was not in the correct initial state for that type of fall to have occurred.

In some embodiments, the one or more processing units are further configured such that an indication that the subject has fallen is not output if the determined status of the subject does not match the initial state for any of the respective types of fall associated with any potential fall indicated in the first input. This means that a care provider or other responder to a fall is not alerted unless the subject is determined to have fallen.

In some embodiments, the initial state of the subject associated with a type of fall comprises any one or more of: (i) a standing posture, (ii) a seated posture, and (iii) a lying posture.

In some embodiments, the respective types of fall associated with the plurality of fall detection algorithms comprise any one or more of: (i) a fall from a standing posture, (ii) a fall from a seated posture, (iii) a fall from a lying posture, (iv) a fall when moving from a seated posture to a standing posture, (v) a fall when moving from a standing posture to a sitting posture, (vi) a fall from a standing posture onto furniture, (vii) a fall from a standing posture in which the subject slides down a wall.

In some embodiments, the one or more processing units are configured to obtain the first input by analysing a set of movement measurements for a subject using the plurality of fall detection algorithms to detect whether there has been a potential fall by the subject of the respective type associated with each fall detection algorithm; and forming the first input from the result of the analysis of the set of movement measurements using the plurality of fall detection algorithms. This has the advantage that the fall detection algorithms and the comparison with the status of the subject can be performed in the same apparatus, so a separate fall detection device is not required. In these embodiments, the one or more processing units can be further configured to receive the set of movement measurements for the subject from one or more sensors that are carried or worn by the subject.

In these embodiments, the set of movement measurements can relate to a first time period, and wherein the one or more processing units are configured to use the plurality of fall detection algorithms to analyse the set of movement measurements to detect whether there has been a potential fall by the subject of the associated type in the first time period. This means that the fall detection algorithms all operate on the same movement measurements to identify falls of the associated types, i.e. each set of movement measurements is evaluated for each of the different types of fall.

In some embodiments, each fall detection algorithm in the plurality of fall detection algorithms can comprise a first fall detection algorithm having a respective threshold or set of thresholds for detecting a potential fall of the associated type. In these embodiments, the first fall detection algorithm can comprise a log likelihood ratio, LLR, table. In these embodiments each fall detection algorithm in the plurality of fall detection algorithms can correspond to a respective point in a receiver-operating characteristic, ROC, curve for the first fall detection algorithm. In alternative embodiments, each fall detection algorithm in the plurality of fall detection algorithms can comprise a respective set of parameters to be analysed from the set of movement measurements.

In alternative embodiments, the one or more processing units are configured to obtain the first input from a fall detection device that is carried or worn by the subject. These embodiments have the advantage that the fall detection apparatus can operate with an existing fall detection device.

In some embodiments, the indication is a fall alert and the indication is output to a call centre or a care provider device.

In some embodiments, the one or more processing units are configured to obtain the second input by analysing a set of measurements from one or more sensors in the environment of the subject to determine the status of the subject prior to a potential fall; and form the second input from the result of the analysis of the set of measurements from one or more sensors in the environment of the subject. This has the advantage that the status determination and the comparison with the output of a plurality of fall detection algorithms can be performed in the same apparatus, so a separate monitoring system is not required.

In alternative embodiments, the one or more processing units are configured to obtain the second input from a monitoring system that includes the one or more sensors in the environment of the subject. These embodiments have the advantage that the fall detection apparatus can be used with an existing monitoring system.

In some embodiments, the one or more sensors in the environment of the subject comprise one or more of (i) a sensor for measuring whether the subject is using an item of furniture; (ii) a sensor for measuring whether the subject is using a wheelchair; (iii) a sensor to measuring whether the subject is in a room; and (iv) a sensor for measuring whether an object in the environment is being used.

In some embodiments, the status of the subject comprises any one or more of (i) sitting on a chair or bed, (ii) lying on a bed, (iii) walking or standing, (iv) sitting in a wheelchair, (v) about to get into a wheelchair.

According to a second specific aspect, there is provided a method of detecting a fall, the method comprising obtaining a first input indicating which one or ones of a plurality of fall detection algorithms have detected a potential fall by the subject, wherein each fall detection algorithm of the plurality of fall detection algorithms is associated with a respective type of fall and detects a potential fall of the associated type by analysing a set of movement measurements for the subject, wherein each respective type of fall has an associated initial state of the subject; obtaining a second input indicating the status of the subject prior to the potential fall, wherein the status of the subject is determined by analysing a set of measurements from one or more sensors in the environment of the subject; comparing the determined status of the subject prior to the potential fall to the initial state for each type of fall associated with any potential fall indicated in the first input; and outputting an indication that the subject has fallen if the determined status of the subject matches the initial state of any of the respective types of fall associated with any potential fall indicated in the first input. Thus, the second aspect provides that information obtained by sensors in the environment of the subject can be used to determine if a potential fall detected by one or more fall detection algorithms adapted for respective types of fall is an actual fall. This improves the reliability of detection of different types of falls.

In some embodiments, the method further comprises determining that the subject has not fallen if the determined status of the subject does not match the initial state for any of the respective types of fall associated with any potential fall indicated in the first input. This means that potential falls identified by a particular fall detection algorithm (associated with a type of fall) can be disregarded where the subject was not in the correct initial state for that type of fall to have occurred.

In some embodiments, an indication that the subject has fallen is not output if the determined status of the subject does not match the initial state for any of the respective types of fall associated with any potential fall indicated in the first input. This means that a care provider or other responder to a fall is not alerted unless the subject is determined to have fallen.

In some embodiments, the initial state of the subject associated with a type of fall comprises any one or more of: (i) a standing posture, (ii) a seated posture, and (iii) a lying posture.

In some embodiments, the respective types of fall associated with the plurality of fall detection algorithms comprise any one or more of: (i) a fall from a standing posture, (ii) a fall from a seated posture, (iii) a fall from a lying posture, (iv) a fall when moving from a seated posture to a standing posture, (v) a fall when moving from a standing posture to a sitting posture, (vi) a fall from a standing posture onto furniture, (vii) a fall from a standing posture in which the subject slides down a wall.

In some embodiments, the step of obtaining the first input comprises analysing a set of movement measurements for a subject using the plurality of fall detection algorithms to detect whether there has been a potential fall by the subject of the respective type associated with each fall detection algorithm; and forming the first input from the result of the analysis of the set of movement measurements using the plurality of fall detection algorithms. This has the advantage that the fall detection algorithms and the comparison with the status of the subject can be performed in the same apparatus, so a separate fall detection device is not required. In these embodiments, the method can further comprise receiving the set of movement measurements for the subject from one or more sensors that are carried or worn by the subject.

In these embodiments, the set of movement measurements can relate to a first time period, and wherein the step of analysing comprises using the plurality of fall detection algorithms to analyse the set of movement measurements to detect whether there has been a potential fall by the subject of the associated type in the first time period. This means that the fall detection algorithms all operate on the same movement measurements to identify falls of the associated types, i.e. each set of movement measurements is evaluated for each of the different types of fall.

In some embodiments, each fall detection algorithm in the plurality of fall detection algorithms can comprise a first fall detection algorithm having a respective threshold or set of thresholds for detecting a potential fall of the associated type. In these embodiments, the first fall detection algorithm can comprise a log likelihood ratio, LLR, table. In these embodiments each fall detection algorithm in the plurality of fall detection algorithms can correspond to a respective point in a receiver-operating characteristic, ROC, curve for the first fall detection algorithm. In alternative embodiments, each fall detection algorithm in the plurality of fall detection algorithms can comprise a respective set of parameters to be analysed from the set of movement measurements.

In alternative embodiments, the step of obtaining the first input comprises obtaining the first input from a fall detection device that is carried or worn by the subject. These embodiments have the advantage that the method can operate with an existing fall detection device.

In some embodiments, the indication is a fall alert and the indication is output to a call centre or a care provider device.

In some embodiments, the step of obtaining the second input comprises analysing a set of measurements from one or more sensors in the environment of the subject to determine the status of the subject prior to a potential fall; and forming the second input from the result of the analysis of the set of measurements from one or more sensors in the environment of the subject. This has the advantage that the status determination and the comparison with the output of a plurality of fall detection algorithms can be performed in the same apparatus, so a separate monitoring system is not required.

In alternative embodiments, the step of obtaining the second input comprises obtaining the second input from a monitoring system that includes the one or more sensors in the environment of the subject. These embodiments have the advantage that the method can be used with an existing monitoring system.

In some embodiments, the one or more sensors in the environment of the subject comprise one or more of (i) a sensor for measuring whether the subject is using an item of furniture; (ii) a sensor for measuring whether the subject is using a wheelchair; (iii) a sensor to measuring whether the subject is in a room; and (iv) a sensor for measuring whether an object in the environment is being used.

In some embodiments, the status of the subject comprises any one or more of (i) sitting on a chair or bed, (ii) lying on a bed, (iii) walking or standing, (iv) sitting in a wheelchair, (v) about to get into a wheelchair.

According to a third aspect, there is provided a computer program product comprising a computer readable medium having computer readable code embodied therein, the computer readable code being configured such that, on execution by a suitable computer or processor, the computer or processor is caused to perform the method according to the second aspect or any embodiment thereof.

According to a fourth aspect, there is provided a fall detection device, that comprises one or more movement sensors for measuring the movements of a subject; one or more processing units configured to receive a set of movement measurements for the subject from the one or more movement sensors; analyse the set of movement measurements using a plurality of fall detection algorithms to detect whether there has been a potential fall by the subject of a respective type of fall associated with each fall detection algorithm, wherein each respective type of fall has an associated initial state of the subject; and form a first input from the result of the analysis of the set of movement measurements using the plurality of fall detection algorithms; and a fall detection apparatus according to the first aspect above. Thus, in this aspect, the fall detection apparatus, or the functions thereof defined in the first aspect, are part of, or implemented by, a fall detection device.

According to a fifth aspect, there is provided a monitoring system that comprises one or more processing units configured to receive a set of measurements from one or more sensors in an environment of a subject; analyse the set of measurements to determine the status of the subject prior to a potential fall; and form a second input from the result of the analysis of the set of measurements; and a fall detection apparatus according to the first aspect above. Thus, in this aspect, the fall detection apparatus, or the functions thereof defined in the first aspect, are part of, or implemented by, a monitoring system.

These and other aspects will be apparent from and elucidated with reference to the embodiment(s) described hereinafter.

BRIEF DESCRIPTION OF THE DRAWINGS

Exemplary embodiments will now be described, by way of example only, with reference to the following drawings, in which.

DETAILED DESCRIPTION OF EMBODIMENTS

Figure 1:
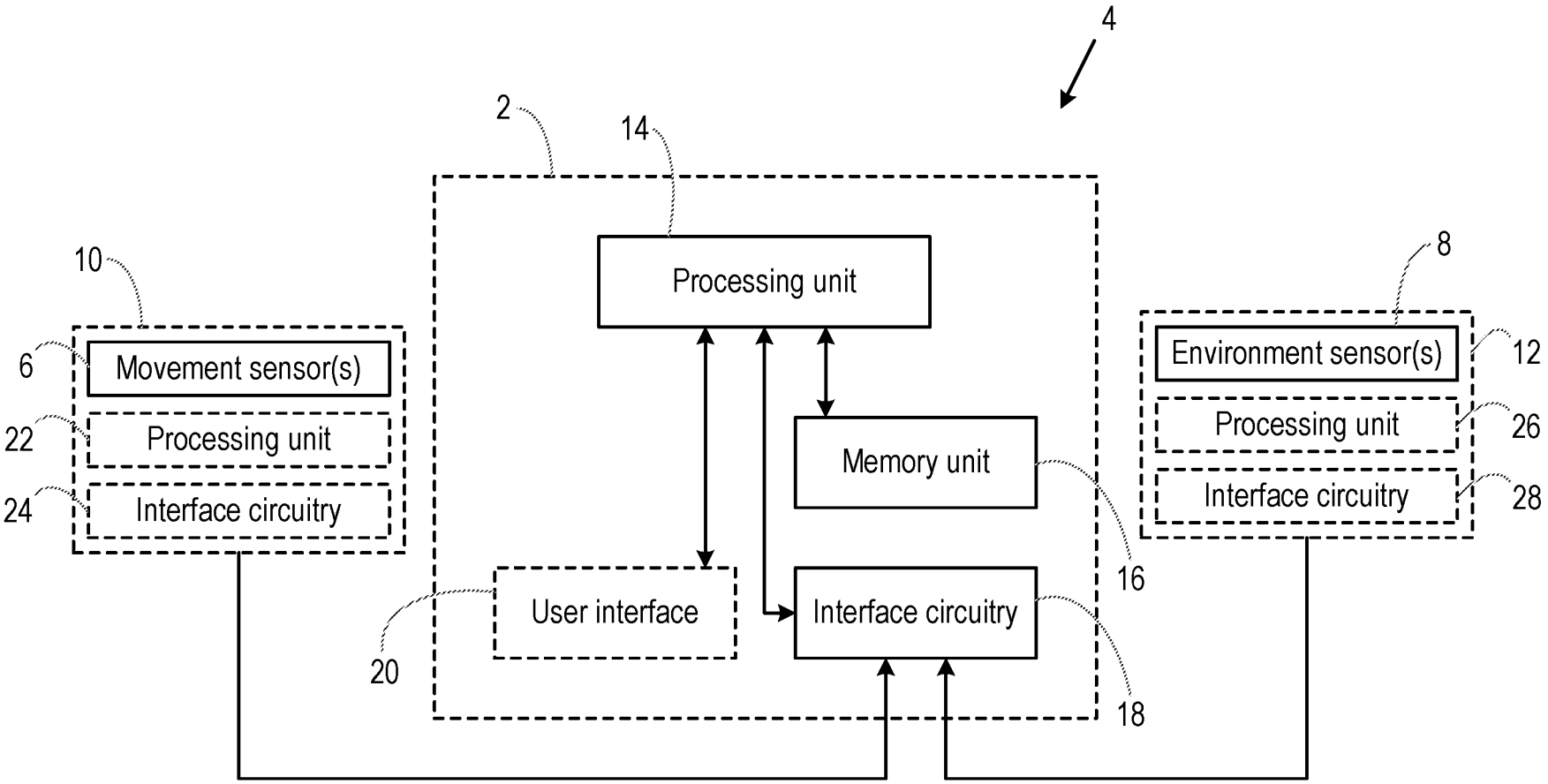
FIG. 1 is a block diagram illustrating an apparatus according to an exemplary embodiment.

As noted above, the invention aims to make use of information obtained by sensors in the environment of the subject to improve the reliability of fall detection, and in particular improving the reliability of the detection of different types of falls, while minimising the occurrence of false alarms.

Fall detection algorithms can be optimised to detect different types of fall, but this means that other types of fall might not be reliably detect by the algorithm. For example an algorithm optimised to reliably detect falls from a standing posture (including when walking), might not reliably detect falls when getting up from a chair, since features characteristic of a fall from standing might not be present in movement measurements corresponding to a fall when trying to stand up, and vice versa.

Thus, movement measurements for a subject can be evaluated by a number of different fall detection algorithms that are each optimised for a respective type of fall (e.g. falling from standing, falling while trying to stand up, etc.), and each algorithm can provide an output indicating whether or not a fall has potentially been detected in the movement measurements. It may be the case that, depending on the particular configuration of the algorithms and the particular movement measurements, more than one fall detection algorithm can indicate a fall at a given time.

One way to implement the different fall detection algorithms is to use the same feature/parameter set (e.g. impact, height change, orientation change, etc.) and the same log likelihood ratio (LLR) tables, but each algorithm can use different decision thresholds for the total LLR value, depending on the type of fall. In other words, a different operating point on a receiver-operating characteristic (ROC) curve can be used for each fall detection algorithm/fall type. As is known, the reliability of a classification method can be visualised by a ROC curve in which the detection probability is plotted against the false alarm rate, and the operating point of an algorithm on the ROC curve can be selected to achieve a required detection probability or false alarm rate. As is known from Detection Theory, an optimal detector is found by testing the so-called likelihood ratio. This ratio expresses the probability on a given feature value (for example, size of impact) in case of a fall divided by the probability on that given feature value in case of a non-fall (i.e. any movement giving rise to the same number but not being a fall). The larger this ratio the more likely the observed event (impact, in the example) is due to a fall. Comparison to a set (by design) threshold enables the detector to conclude that the event is a fall or is not a fall. The likelihood ratio for a range of feature values (impact sizes, in the example) is commonly stored in a table. For ease of computation, the logarithm of the ratio is stored rather than the ratio itself.

Another way to implement the different fall detection algorithms is to, for example, use a different set of features/parameters for one or more of the fall detection algorithms that are appropriate for the type of fall that is to be detected. For example, the set of parameters used by a fall detection algorithm to detect falls when the subject is close to or seated in a chair (including a wheelchair), may be different to the set of parameters used by a fall detection algorithm to detect falls when the subject is walking. Example features/parameters that can be used include the time window over which a height change is computed, the required height change over the event, and the decision threshold of the overall likelihood between falls and non-falls. Alternatively or in addition, the LLR table used by each algorithm can also be different, with the LLR table fitting to the distribution corresponding to the associated fall type. For example, the LLR table for the height change when falling from a chair may have its largest likelihood at a lower height change compared to the LLR table for falls from stance. Similarly, the impact and/or orientation LLR tables can reflect different log likelihood values. It may also or alternatively be the case that the way in which the features/parameters are computed is different between the different algorithms, for example using different signal processing techniques.

As noted above, it is desirable to be able to make use of the information available from one or more sensors in the home environment, for example sensors that are part of a home monitoring system. Therefore, the status of the subject that can be derived from measurements from the environment sensor(s) can be used to 'filter' or 'validate' the output of any fall detection algorithm that indicates that a potential fall may have taken place. For example, based on a set of movement measurements, a fall detection algorithm optimised for detecting falling out of bed may indicate that the subject may have fallen (with the fall detection algorithms optimised for other types of fall not indicating a potential fall), but the status of the subject derived from the environment sensor(s) may indicate that the subject is walking around the house (and that the subject was not in bed at the time the potential fall was indicated). In that case, it is possible to dismiss or ignore the potential fall indicated by the falling-out-of-bed-optimised fall detection algorithm as it is not consistent with the current status of the subject provided by the environment sensor(s). On the other hand, if the environment sensor(s) indicated that the subject was in bed at the time (and/or prior to the time) that the potential fall was detected, then the potential fall is consistent with the status of the subject, and a fall can be positively detected (with an alarm being triggered and/or an alert being sent).

In a particular embodiment of the invention, a fall detection device (e.g. a personal help button (PHB) that includes one or more movement sensors) that is carried or worn by a subject can evaluate movement measurements using a range of fall detection algorithms, with each algorithm deciding, for a given (triggered) event (i.e. set of movement measurements meeting some trigger condition), whether the event is a fall assuming a certain situation (e.g. a fall from stance, a fall from a chair, a fall from a bed, etc.). The algorithms may share computation components, i.e. the algorithms can be evaluated by the same processing unit in the fall detection device.

In some embodiments, a first part of the analysis of the movement measurements may be common to all of the fall detection algorithms, with the individual fall detection algorithms being used if a trigger condition is met. Alternatively, a first part of the analysis may be different for different fall detection algorithms. In either case, the movement measurements (e.g. acceleration, air pressure, etc.) are received and a test can be run on the measurements to determine whether the trigger condition is met. For example, it can be tested whether the air pressure has risen relative to the air pressure some time period (e.g. 2 seconds) earlier by an amount larger than an air pressure change equivalent to a predetermined height change (e.g. 50 cm). An accelerometer based trigger condition could observe an orientation change in a similar fashion, or observe for an impact (e.g. the magnitude of the norm of the accelerometer signals exceeds some threshold). If in this way a trigger happens (i.e. the trigger condition is met), the segment of movement measurements (i.e. segment of a movement measurement signal) around the time that trigger condition was met is forwarded for further processing. In this way the use of the trigger condition converts the (potentially continuous) sensor signals/measurements into a sequence of (discrete) events. The trigger condition should require low complexity and low power consumption to evaluate. It should pass all 'true' falls and pass as few 'non-falls' as possible (although it will be appreciated that the main suppression of non-falls is the task of the subsequent fall detection algorithms, but the rate of these non-fall events sets the calling rate of the fall detection device).

In case one or more of the algorithms decides the event is a fall, each positive decision (i.e. detected fall) can be communicated (e.g. transmitted) to a central console (referred to as a fall detection apparatus below) in the home or care environment. Each positive decision can be labelled with the type of algorithm/situation that produced the positive decision (i.e. a fall from stance, a fall from a chair, a fall from a bed, etc.).

The central console can be connected to (or at least able to receive information from) a pre-existing home or care environment monitoring system (for example a burglar surveillance system, a fire/smoke detection system, and/or an activities of daily living (ADL) monitoring system). The monitoring system implements and handles the discovery and communication with any environmental sensors in the home or care environment (thereby avoiding any need for the fall detection device or central console to do that). The monitoring system can also implement and execute algorithms that analyse the environmental sensor measurements to determine the status of the subject in the home or care environment. This status is provided to the central console.

The environment sensors can include sensors that can be placed at or on furniture, or otherwise be associated with items of furniture, such as a chair, a couch, a bed, a cupboard, a shower, at a bed side cabinet, etc. These sensors can be used to measure whether the subject is using the particular item of furniture and/or is near to the particular item of furniture.

When the central console receives an indication of a detected fall by the fall detection device and the associated fall-type label(s), the console tests whether that fall type coincides with the situation as currently inferred by the monitoring system. If so, an alarm that the subject has fallen is forwarded to a call centre or other help providing entity (e.g. the emergency services). In some implementations, if the fall detection algorithm for detecting a fall from stance (i.e. standing) detects a potential fall, an alert or alarm may always be triggered (e.g. it can be excluded from the test against the current status, or a mismatch with the current status may be ignored).

In another particular embodiment of the invention (which can be used in combination with or separately from the home monitoring system used in the above particular embodiment), an environment sensor can be provided to detect when a subject is sitting in a wheelchair, and/or is about to be seated in a wheelchair (i.e. the sensor can be used to detect if the subject is standing in front of the wheelchair). Examples of such sensors include passive infrared (PIR) sensors, ultrasound (US) sensors, radar-based sensors, near-field communication (NFC) sensors, pressure sensors (i.e. for detecting pressure or force applied to part of the wheel chair, e.g. the seat portion and/or handles/hand grips), light sensors (e.g. photodiodes) for sensing a light beam from, e.g. a laser or light emitting diode, LED, etc. A fall detection algorithm can be provided or used that evaluates whether a fall from a wheelchair has occurred (either from the wheelchair or when trying to sit down in, and/or get up from, the wheelchair). A positive fall indication from the fall detection algorithm can be compared to measurements from the environment sensor associated with the wheelchair, and a fall detected if the subject was sat in or close to the wheelchair at a time corresponding to the time at which the fall was detected by the algorithm.

In some embodiments, if the wheelchair is an electric wheelchair and/or otherwise has an electronically actuated brake (for preventing movement of the wheelchair), the brake can be automatically actuated to prevent movement of the wheelchair if the environment sensor detects that the subject is standing in front of the wheelchair. If the sensor (or another) detects that the subject has sat down in the wheelchair, then the brake can be released (unless manually applied by the subject).

It will be appreciated that in some implementations the environment sensors can be operating continuously or periodically to monitor the environment/subject, in which case the status of the subject may be determined continuously or periodically. Alternatively, the environment sensors can be operating continuously or periodically to monitor the environment/subject, but the processing to determine the status of the subject may only be performed when required (e.g. following receipt of a positive fall indication from one or more fall detection algorithms). As another alternative, the environment sensors may only measure the environment/subject when requested to do so (e.g. following receipt of a positive fall indication from one or more fall detection algorithms). This alternative reduces the energy consumption of the system.

FIG. 1 illustrates an exemplary fall detection apparatus 2 that can be used to implement various embodiments of the invention. The apparatus 2 is shown as part of a system 4 that includes one or more movement sensors 6 that are provided to measure the movements of a subject and one or more environment sensors 8 that are provided to measure an aspect of the environment of the subject. The fall detection apparatus 2 is provided for detecting if a subject has fallen by comparing a status of the subject prior to a potential fall (as determined from measurements from the environment sensor(s) 8) to an initial state for a type of fall associated with any fall detection algorithm that has detected a potential fall by the subject (as determined from measurements from the movement sensor(s) 6), and outputting an indication that the subject has fallen if there is a match between the status and an initial state. As such, the fall detection apparatus 2 can also be referred to as a fall decision apparatus 2 since it takes a final decision on whether a fall has occurred and an alarm should be triggered or an alert issued.

In some embodiments, the measurements from the movement sensor(s) 6 are provided to the fall detection apparatus 2, and the fall detection apparatus 2 analyses the movement measurements using a plurality of fall detection algorithms to detect a potential fall by the subject. In other embodiments, the movement sensor(s) 6 can be integral with the fall detection apparatus 2. In this case, the fall detection apparatus 2 can be worn or carried by the subject, and may be in the form of a watch, bracelet, necklace, chest band, etc. In other embodiments, the movement sensor(s) 6 are part of a separate fall detection device 10 (indicated by dashed box 10 around the movement sensor(s) 6), and the fall detection device 10 applies the fall detection algorithms to the movement measurements to detect a potential fall by the subject. The fall detection device 10 can be carried or worn by the subject, and can, for example, include a PHB. The fall detection device 10 can be in the form of a watch, bracelet, necklace, chest band, etc. It will be appreciated that the fall detection device 10, where present, merely provides an input to the fall detection apparatus 2 indicating the outcome of the analysis of the movement measurements by the plurality of fall detection algorithms. The fall detection apparatus 2 determines whether a fall alert should be issued based on a comparison of the fall detection algorithm results with the status of the subject determined from the environment sensor(s) 8. In some alternative embodiments, the functions of the fall detection apparatus 2 described herein are part of, or implemented by, the fall detection device 10. In these embodiments, the fall detection device 2 can be worn or carried by the subject, and may be in the form of a watch, bracelet, necklace, chest band, etc., and may include or be connected to the movement sensor(s) 6.

In some embodiments, the measurements from the environment sensor(s) 8 are provided to the fall detection apparatus 2, and the fall detection apparatus 2 analyses the measurements to determine a status of the subject. In other embodiments, one or more of the environment sensor(s) 8 can be integral with the fall detection apparatus 2 (with optionally other environment sensor(s) 8 being separate from the fall detection apparatus 2). In other embodiments, the environment sensor(s) 8 are part of a monitoring system 12 (indicated by dashed box 12 around the environment sensor(s) 8). In some alternative embodiments, the functions of the fall detection apparatus 2 described herein are part of, or implemented by, the monitoring system 12.

It will be appreciated that various combinations of the embodiments in the preceding two paragraphs is possible. For example, the fall detection apparatus 2 can perform all of the processing of the sensor measurements (e.g. analysis of the movement measurements received from the movement sensor(s) 6 using a plurality of fall detection algorithms and analysis of the environment sensor measurements received from the environment sensor(s) 8 (where one of the movement sensor(s) 6 and environment sensor(s) 8 may be integral with the fall detection apparatus 2) to determine the status of the subject), perform none of the processing of the sensor measurements (e.g. the fall detection apparatus 2 receives the result of the fall detection algorithm analysis from fall detection device 10 and receives the status of the subject from the monitoring system 12), or perform the processing of one set of sensor measurements while receiving the result of the processing of the other set of sensor measurements. In any of the above embodiments, the one or more movement sensors 6 are carried or worn by the subject, and the one or more environment sensors 8 are located in the environment of the subject (i.e. they are not worn or carried by the subject).

The fall detection apparatus 2 includes a processing unit 14 that controls the operation of the fall detection apparatus 2 and that can be configured to execute or perform the methods described herein. The processing unit 14 can be implemented in numerous ways, with software and/or hardware, to perform the various functions described herein. The processing unit 14 may comprise one or more microprocessors or digital signal processor (DSPs) that may be programmed using software or computer program code to perform the required functions and/or to control components of the processing unit 14 to effect the required functions. The processing unit 14 may be implemented as a combination of dedicated hardware to perform some functions (e.g. amplifiers, pre-amplifiers, analog-to-digital convertors (ADCs) and/or digital-to-analog convertors (DACs)) and a processor (e.g., one or more programmed microprocessors, controllers, DSPs and associated circuitry) to perform other functions. Examples of components that may be employed in various embodiments of the present disclosure include, but are not limited to, conventional microprocessors, DSPs, application specific integrated circuits (ASICs), and field-programmable gate arrays (FPGAs).

The processing unit 14 is connected to a memory unit 16 that can store data, information and/or signals for use by the processing unit 14 in controlling the operation of the fall detection apparatus 2 and/or in executing or performing the methods described herein. In some implementations the memory unit 16 stores computer-readable code that can be executed by the processing unit 14 so that the processing unit 14 performs one or more functions, including the methods described herein. The memory unit 16 can comprise any type of non-transitory machine-readable medium, such as cache or system memory including volatile and non-volatile computer memory such as random access memory (RAM) static RAM (SRAM), dynamic RAM (DRAM), read-only memory (ROM), programmable ROM (PROM), erasable PROM (EPROM) and electrically erasable PROM (EEPROM), implemented in the form of a memory chip, an optical disk (such as a compact disc (CD), a digital versatile disc (DVD) or a Blu-Ray disc), a hard disk, a tape storage solution, or a solid state device, including a memory stick, a solid state drive (SSD), a memory card, etc.

The fall detection apparatus 2 also includes interface circuitry 18 for enabling a data connection to and/or data exchange with other devices, including any one or more of servers, databases, user devices, and sensors. The connection may be direct or indirect (e.g. via the Internet), and thus the interface circuitry 18 can enable a connection between the fall detection apparatus 2 and a network, such as the Internet, via any desirable wired or wireless communication protocol. For example, the interface circuitry 18 can operate using WiFi, Bluetooth, Zigbee, or any cellular communication protocol (including but not limited to Global System for Mobile Communications (GSM), Universal Mobile Telecommunications System (UMTS), Long Term Evolution (LTE), LTE-Advanced, etc.). In the case of a wireless connection, the interface circuitry 18 (and thus fall detection apparatus 2) may include one or more suitable antennas for transmitting/receiving over a transmission medium (e.g. the air). Alternatively, in the case of a wireless connection, the interface circuitry 18 may include means (e.g. a connector or plug) to enable the interface circuitry 18 to be connected to one or more suitable antennas external to the fall detection apparatus 2 for transmitting/receiving over a transmission medium (e.g. the air). The interface circuitry 18 is connected to the processing unit 14.

The interface circuitry 18 can be used to receive movement measurements from the movement sensor(s) 6 or, where the movement sensor(s) 6 are part of a fall detection device 10, the interface circuitry 18 can be used to receive the result of the analysis of movement measurements by a plurality of fall detection algorithms. The interface circuitry 18 can also be used to receive measurements from the environment sensor(s) 8, or, where the environment sensor(s) 8 are part of a monitoring system 12, the interface circuitry 18 can be used to receive the determined status of the subject.

The interface circuitry 18 can also be used to output an indication that the subject has fallen. In that case, the interface circuitry 18 can communicate the indication to a call centre or the emergency services and/or communicate the indication to a user device of a physician or care provider.

In some embodiments, the fall detection apparatus 2 comprises a user interface 20 that includes one or more components that enables a user of fall detection apparatus 2 (e.g. the subject, or a care provider for the subject) to input information, data and/or commands into the fall detection apparatus 2, and/or enables the fall detection apparatus 2 to output information or data to the user of the fall detection apparatus 2. An output may be an audible alarm or alert that the subject has fallen. The user interface 20 can comprise any suitable input component(s), including but not limited to a keyboard, keypad, one or more buttons, switches or dials, a mouse, a track pad, a touchscreen, a stylus, a camera, a microphone, etc., and the user interface 20 can comprise any suitable output component(s), including but not limited to a display screen, one or more lights or light elements, one or more loudspeakers, a vibrating element, etc.

The fall detection apparatus 2 can be any type of electronic device or computing device. For example the fall detection apparatus 2 can be, or be part of, a server, a computer, a laptop, a tablet, a smartphone, a smartwatch, etc.

It will be appreciated that a practical implementation of a fall detection apparatus 2 may include additional components to those shown in FIG. 1. For example the fall detection apparatus 2 may also include a power supply, such as a battery, or components for enabling the fall detection apparatus 2 to be connected to a mains power supply.

In embodiments where the movement sensor(s) 6 are part of a fall detection device 10, the fall detection device 10 may include a processing unit (shown by dashed box 22) for analysing the movement measurements using the plurality of fall detection algorithms and determining whether the subject has potentially suffered a fall. The fall detection device 10 may also include interface circuitry (shown by dashed box 24) for enabling the result of the analysis of the movement measurements to be communicated to the fall detection apparatus 2. The processing unit 22 and/or interface circuitry 24 may be implemented in similar ways to the processing unit 14 and/or interface circuitry 18 in the fall detection apparatus 2.

In embodiments where the environment sensor(s) 8 are part of a monitoring system 12, the monitoring system 12 may include a processing unit (shown by dashed box 26) for analysing the environment sensor measurements and determining the status of the subject. The monitoring system 12 may also include interface circuitry (shown by dashed box 28) for enabling the determined status to be communicated to the fall detection apparatus 2. The processing unit 26 and/or interface circuitry 28 may be implemented in similar ways to the processing unit 14 and/or interface circuitry 18 in the fall detection apparatus 2.

The one or more movement sensor(s) 6 can include any type of sensor(s) for measuring the movements of a subject, or for providing measurements representative of the movements of a subject. For example, the movement sensor(s) 6 can include any one or more of an accelerometer, a magnetometer, a satellite positioning system receiver (e.g. a GPS receiver, a GLONASS receiver, a Galileo positioning system receiver), a gyroscope, and an air pressure sensor (that can provide measurements indicative of the altitude of the subject or changes in height/altitude of the subject).

The one or more environment sensor(s) 8 can include any type of sensor(s) for monitoring an aspect of an environment or an aspect of an object in an environment. For example, the environment sensor(s) 8 can include one or more sensors 8 for detecting whether the subject is using an item of furniture, one or more sensors 8 for measuring or detecting whether the subject is using a wheelchair, one or more sensors 8 for measuring whether the subject is in a particular room, and/or one or more sensors 8 for measuring whether an object in the environment is being used. The environment sensor(s) 8 may be or include any one or more of an accelerometer, a gyroscope, a PIR sensor, an US sensor, a radar-based sensor, a light-based sensor, a radio frequency (RF) signal-based sensor (e.g. using WiFi, Bluetooth, Zigbee, etc.) from which signal strength measurements can be obtained, an NFC sensor, a pressure sensor (i.e. for detecting pressure or force applied to part of an object), a camera, etc.

In some embodiments, in addition to the movement sensor(s) 6, one or more physiological characteristic sensors can be provided for monitoring or measuring physiological characteristics of the subject, and these physiological characteristic measurements can be evaluated as part of the fall detection algorithm(s). For example, physiological characteristics such as heart rate, skin conductivity, breathing rate, blood pressure and/or body temperature can vary following a fall, and therefore an evaluation of these measurements can provide useful information for determining whether a subject has fallen. The one or more physiological characteristic sensors can include a photoplethysmograph (PPG) sensor that can measure heart rate, heart rate-related characteristics and breathing rate, a skin conductivity sensor, blood pressure monitor, thermometer, etc.

It will be appreciated that where an environmental sensor 8 is for monitoring a particular object (e.g. a particular item of furniture), the environment sensor(s) 8 may include respective environment sensors 8 for monitoring respective items of furniture (e.g. a respective pressure sensor can be provided on each chair in the environment). Likewise, where an environmental sensor 8 is for monitoring the presence of the subject in a particular room, the environment sensor(s) 8 may include respective environment sensors 8 for monitoring respective rooms (e.g. a respective PIR sensor can be provided in a bedroom, kitchen, bathroom, etc.

Figure 2:
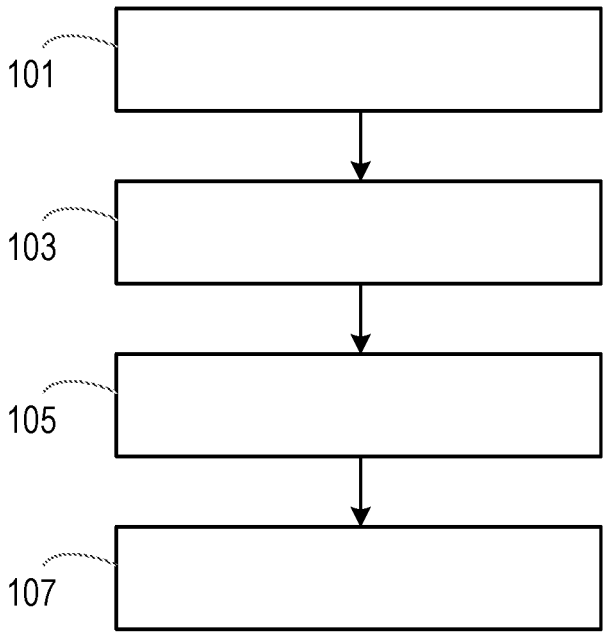
FIG. 2 is a flow chart illustrating a method according to an exemplary embodiment.

The flow chart in FIG. 2 illustrates an exemplary method according to the techniques described herein. One or more of the steps of the method can be performed by the processing unit 14 in the apparatus 2, in conjunction with any of the memory unit 16, interface circuitry 18 and user interface 20 as appropriate. The processing unit 14 may perform the one or more steps in response to executing computer program code, that can be stored on a computer readable medium, such as, for example, the memory unit 16.

In a first step, step 101, the processing unit 14 obtains an input (referred to for clarity as a "first" input) indicating which one or ones of a plurality of fall detection algorithms have detected a potential fall by the subject. Each fall detection algorithm is associated with a respective type of fall and detects a potential fall of the associated type by analysing a set of movement measurements for the subject. Each respective type of fall has an associated initial state of the subject, i.e. a posture or state of the subject immediately before the fall.

Some exemplary types of fall that can be detected using respective fall detection algorithms and their respective initial states include (but are not limited to) any one or more of a fall from a standing posture, including when walking, jogging or running (with the initial state being a standing posture), a fall from a seated posture (with the initial state being a seated posture), a fall from a lying posture (with the initial state being a lying posture), a fall when moving from a seated posture to a standing posture (with the initial state being a seated posture), a fall when moving from a standing posture to a sitting posture (with the initial state being a standing posture), a fall from a standing posture onto furniture (with the initial state being a standing posture), and a fall from a standing posture in which the subject slides down a wall (with the initial state being a standing posture).

In some embodiments, step 101 comprises obtaining the first input from a fall detection device 10 that is carried or worn by the subject.

In alternative embodiments, step 101 comprises the processing unit 14 determining the first input by analysing a set of movement measurements from the movement sensor(s) 6 using the plurality of fall detection algorithms to detect whether there has been a potential fall by the subject of the respective type associated with each fall detection algorithm. The first input can be formed from the result of the analysis of the set of movement measurements using the plurality of fall detection algorithms. In this embodiment, the processing unit 14 can receive the set of movement measurements are obtained using the movement sensor(s) 6.

In either embodiment of step 101, the set of movement measurements relate to a first time period, and the plurality of fall detection algorithms are used (either by a fall detection device 10 or the processing unit 14) to analyse the set of movement measurements to detect whether there has been a potential fall by the subject of the associated type in the first time period. That is, the plurality of fall detection algorithms are used to evaluate the same time period of measurements for a potential fall.

In some embodiments, each fall detection algorithm in the plurality of fall detection algorithms use the same (shared) fall detection algorithm (e.g. extracted feature sets), but have a respective threshold or set of thresholds for detecting a potential fall of the associated type. The shared fall detection algorithm can comprise a LLR table. Each fall detection algorithm in the plurality can correspond to a respective point in a ROC for the shared fall detection algorithm.

Alternatively, each fall detection algorithm in the plurality of fall detection algorithms can comprise a respective set of parameters or features to be analysed or extracted from the set of movement measurements.

It will be appreciated that each fall detection algorithm can be trained or configured based on known falls of the appropriate type. For example the parameters, features, LLR table and/or thresholds of a fall detection algorithm for detecting a fall from a lying posture can be trained based on movement measurements from known falls from a bed.

Next, in step 103, the processing unit 14 obtains an input (referred to for clarity as a "second" input) indicating the status of the subject prior to a potential fall. The status of the subject is determined from an analysis of a set of measurements from one or more environmental sensors 8 in the environment of the subject.

Step 103 can comprise obtaining the second input from a monitoring system 12 that includes the one or more sensors 8 in the environment of the subject.

Alternatively, step 103 can comprise the processing unit 14 receiving a set of measurements from the one or more sensors 8 in the environment of the subject, analysing the set of measurements from the one or more sensors 8 to determine the status of the subject prior to a potential fall and forming the second input from the result of the analysis of the set of measurements from one or more sensors in the environment of the subject.

The status of the subject indicated in the second input can comprise any one or more of sitting on a chair or bed, lying on a bed, walking (including jogging or running) or standing, sitting in a wheelchair, and about to get into a wheelchair.

Techniques for analysing environmental sensor measurements to determine a current status of a subject, such as their location (the room they are in), an object that the subject is using (e.g. sitting in a chair, pouring a kettle, etc.) are known in the art, and details are not provided herein. Such processing techniques are known, for example, in terms of systems and devices that determine the activities of daily living (ADL) of a subject. In any case, it will be appreciated that many such processing techniques can be straightforward to implement. For example if a pressure sensor on a chair indicates a person is sitting on the chair, then it can be inferred that the subject is sitting on the chair associated with that pressure sensor. In a similar example, several pressure sensors can be provided at different positions on a bed, and a high pressure measured by one sensor can indicate that the subject is sitting on the bed, and a high pressure measured by several sensors can indicate that the subject is lying on the bed. If the subject is detected as being in a living room and the television is switched on, it could be inferred that the subject is sitting down.

In step 105, the determined status of the subject prior to a potential fall (from the second input) is compared to the initial state for each type of fall associated with any potential fall indicated in the first input. That is, for any type of fall indicated in the first input, the initial state is compared to the determined status of the subject.

Then, in step 107, if the determined status of the subject matches the initial state of any of the respective types of fall associated with any potential fall indicated in the first input, then a fall is detected and an indication that a fall has occurred is output by the fall detection apparatus 2. The indication can be a fall alert. For example, if the first input indicates two potential falls, with one potential fall being from a fall detection algorithm that evaluates for falls when moving from a standing posture to a sitting posture, and the other potential fall being from a fall detection algorithm that evaluates for falls from a seated posture, and the determined status prior to the potential fall was that the subject was sitting on a chair, then a match has occurred, and a fall from a seated posture is identified.

The indication may be output in the form of an audible alarm, a visible message or light, or a signal that is transmitted to a care provider device, physician device, call centre or emergency service.

If in step 105 the determined status of the subject does not match the initial state for any of the respective types of fall associated with any potential fall indicated in the first input, then the processing unit 14 determines that the subject has not fallen. In this case, no indication that the subject has fallen is output. In the above example, if the determined status prior to the potential fall was that the subject was lying on a bed, then there is no match, and no fall is detected.

Thus, the above method provides a number of improvements to the reliability of fall detection. Firstly, the different fall detection algorithms can each be optimised for detecting a respective type of fall (e.g. falling from standing, falling while trying to stand up, etc.), increasing the chance of successfully detecting a particular type of fall. However in recognition of these optimised fall detection algorithms having a higher false alarm rate in circumstances where the subject is not in the appropriate initial state (e.g. the output of a fall-from-standing detection algorithm will be less reliable if the subject is lying down rather than standing), the status of the subject is determined using sensors in the environment of the subject and used to check whether any indicated potential fall is plausible. Thus in the case where one of the plurality of fall detection algorithms has detected a potential fall by the subject, the status of the subject prior to the potential fall is checked against the initial state associated with the fall detection algorithm that detected the potential fall to make sure that the potential fall was plausible given the status of the subject prior to the potential fall being detected. Using the status of the subject therefore acts as a check against a positive detection of a potential fall, thereby improving the reliability of the fall detection. In the case where multiple ones of the plurality of fall detection algorithms indicate a potential fall by the subject, the status of the subject prior to the potential fall is checked against the initial state associated with the multiple fall detection algorithms that detected the potential fall to determine whether any of the potential falls is plausible given the status of the subject prior to the detected potential fall. The use of the status of the subject therefore acts as a check against a positive detection of a potential fall by multiple fall detection algorithms, and, if a fall has occurred, enables a more reliable detection of the type of fall. In either of the above examples, if the status of the subject does not match the detection of a potential fall by a particular fall detection algorithm, then that potential fall can be dismissed as a false alarm as it is inconsistent with the initial state of the subject (and likely triggered by that fall detection algorithm being optimised for a different type of fall with a different initial state).

There is therefore provided an improved technique for fall detection that can make use of information obtained by sensors in the environment of the subject to improve the reliability of fall detection, and to improve the reliability of the detection of different types of falls.

Variations to the disclosed embodiments can be understood and effected by those skilled in the art in practicing the principles and techniques described herein, from a study of the drawings, the disclosure and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A fall detection apparatus comprising:

a memory circuit; and a processor circuit, wherein the processor circuit is arranged to obtain a first input, wherein the first input indicates a selected fall detection algorithm, wherein the selected fall detection algorithm is selected from a plurality of fall detection algorithms, wherein the detection of a fall by user is detected by the selected fall detection algorithm, wherein each fall detection algorithm of the plurality of fall detection algorithms is associated with a respective fall type, wherein each of plurality of detection algorithms detects a potential fall of the associated type by analyzing a set of movement measurements for the user, wherein each respective fall type has an associated initial status of the user, wherein the processor circuit is arranged to obtain a second input, wherein the second input indicates a first status of the user, wherein the first status is the user status prior to the potential fall, wherein the first status of the user is determined by analyzing a set of measurements from at least one sensor, wherein the at least one sensor is in the environment of the user, wherein the at least one sensor is not attached to the user, wherein the at least one sensor is independent of the fall detection algorithm, wherein the processor circuit is arranged to compare the first status to the initial status for the fall type of the selected fall detection algorithm, wherein the processor circuit is arranged to output an indication that the user has fallen if the first status of the user matches the initial status of the selected fall detection algorithm; and wherein the processor circuit is arranged to dismiss a first potential fall indicated by the first input if the first status of the user does not match the initial status of any of the fall types.

2. The fall detection apparatus as claimed in claim 1, wherein the initial status of the user associated with a fall type comprises at least one of a standing posture, a seated posture, and a lying posture.

3. The fall detection apparatus as claimed in claim 1, wherein the fall types associated with the plurality of fall detection algorithms comprise one or more of a fall from a standing posture, a fall from a seated posture, a fall from a lying posture, a fall when moving from a seated posture to a standing posture, a fall when moving from a standing posture to a sitting posture, a fall from a standing posture onto furniture, and a fall from a standing posture in which the user slides down a wall.

4. The fall detection apparatus as claimed in claim 1, wherein the processor circuit is arranged to obtain the first input by analyzing a set of movement measurements for a user using the plurality of fall detection algorithms, wherein the processor circuit is arranged to detect whether there has been a potential fall by the user; and wherein the processor circuit is arranged to form the first input from the result of the analysis.

5. The fall detection apparatus as claimed in claim 1, wherein the processor circuit is arranged to obtain the first input from a fall detection device that is carried or worn by the user.

6. The fall detection apparatus as claimed in claim 1, wherein the processor circuit is arranged to obtain the second input by analyzing a set of measurements from the at least one sensor in the environment of the user to determine the status of the user prior to a potential fall; and wherein the processor circuit is arranged to form the second input from the result of the analysis.

7. The fall detection apparatus as claimed in claim 1, wherein the one or more processing units are configured wherein the processor circuit is arranged to obtain the second input from a monitoring system, wherein the monitoring system comprises the at least one sensor in the environment of the user.

8. The fall detection apparatus as claimed in claim 1, wherein the set of movement measurements comprises at least one measurement from an air pressure sensor.

9. A monitoring system, comprising:

the fall detection apparatus as claimed in claim 1, wherein the processor circuit is arranged to receive the plurality of measurements from the at least one sensor in the environment of the user, wherein the processor circuit is arranged to analyze the plurality of measurements to determine the status of the user prior to a potential fall, wherein the processor circuit is arranged to form the second input from the result of the analysis.

10. The fall detection apparatus as claimed in claim 1, wherein the processor circuit is arranged to filter the first input based on the first status.

11. A method of detecting a fall, the method comprising:

obtaining a first input, wherein the first input indicates a selected fall detection algorithm, wherein the selected fall detection algorithm is selected from a plurality of fall detection algorithms, wherein the detection of a fall by user is detected by the selected fall detection algorithm, wherein each fall detection algorithm of the plurality of fall detection algorithms is associated with a respective fall type, wherein each of plurality of detection algorithms detects a potential fall of the associated type by analyzing a set of movement measurements for the user, wherein each fall type has an associated initial status of the user; obtaining a second input, wherein the second input indicates a first status, wherein the first status is the user status prior to the potential fall, wherein the first status is determined by analyzing a set of measurements from at least one sensor, wherein the at least one sensor is in the environment of the user, wherein the at least one sensor is not attached to the user, wherein the at least one sensor is independent of the selected fall detection algorithm;

comparing the first status to the initial status for the fall type of the selected fall detection algorithm; and outputting an indication that the user has fallen if the first status matches the initial status of the selected fall detection algorithm.

12. The method as claimed in claim 11, wherein obtaining the first input comprises:

analyzing a set of movement measurements for a user using the plurality of fall detection algorithms to detect whether there has been a potential fall by the; and forming the first input from the result of the analysis.

13. The method as claimed in claim 11, wherein the obtaining the first input comprises obtaining the first input from a fall detection device that is carried or worn by the user.

14. The method as claimed in claim 11, wherein the step of obtaining the second input comprises:

analyzing a set of measurements from the at least one sensor to determine the status of the user prior to a potential fall; and forming the second input from the result of the analysis.

15. The method as claimed in claim 11, wherein the obtaining the second input comprises obtaining the second input from a monitoring system, wherein the monitoring system comprises the at least one sensor.

16. The method as claimed in claim 11, wherein the set of movement measurements comprise at least one measurement from an air pressure sensor.

17. The method as claimed in claim 11, further comprising filtering the first input based on the first status.

18. A non-transitory computer-readable medium comprising a computer program, wherein the computer program, when executed on a processor, performs the method as claimed in claim 11.

* * * * *